US009283971B2

(12) United States Patent
Smileski et al.

(10) Patent No.: US 9,283,971 B2
(45) Date of Patent: Mar. 15, 2016

(54) INTEGRATED BOGIE BRAKE AND SLACK ADJUSTER FOR THE USE WITH SAID INTEGRATED BOGIE BRAKE

(71) Applicant: WABTEC MZT, Skopje (MK)

(72) Inventors: Stojce Smileski, Skopje (MK); Tasko Smileski, Skopje (MK)

(73) Assignee: Wabtec MZT, Skopje (MK)

( * ) Notice: Subject to any disclaimer, the term of this patent is extended or adjusted under 35 U.S.C. 154(b) by 0 days.

(21) Appl. No.: 14/366,044

(22) PCT Filed: Dec. 27, 2012

(86) PCT No.: PCT/EP2012/076987
§ 371 (c)(1),
(2) Date: Jun. 17, 2014

(87) PCT Pub. No.: WO2013/098350
PCT Pub. Date: Jul. 4, 2013

(65) Prior Publication Data
US 2015/0027825 A1 Jan. 29, 2015

(30) Foreign Application Priority Data
Dec. 27, 2011 (MK) ..... P-2011/402

(51) Int. Cl.

| | |
|---|---|
| ***F16D 65/52*** | (2006.01) |
| ***B61H 15/00*** | (2006.01) |
| ***B61H 13/24*** | (2006.01) |
| ***B61H 13/36*** | (2006.01) |
| ***B61H 1/00*** | (2006.01) |

(52) U.S. Cl.
CPC ..... *B61H 15/0092* (2013.01); *B61H 1/00* (2013.01); *B61H 13/24* (2013.01); *B61H 13/36* (2013.01)

(58) Field of Classification Search
CPC .... B61H 13/24; B61H 13/36; B61H 15/0092; B61H 1/00
USPC ..... 188/198, 202, 214, 215, 219.1, 219.6, 188/220.1, 222.1, 222.6, 223.6, 223.1, 188/224.1; 105/167, 172, 206.1, 182.1
See application file for complete search history.

(56) References Cited

U.S. PATENT DOCUMENTS

| | | | | |
|---|---|---|---|---|
| 5,507,368 | A | 4/1996 | Barefoot | |
| 5,947,236 | A | 9/1999 | Sauter | |
| 6,279,696 | B1 * | 8/2001 | Daugherty et al. | 188/215 |
| 7,165,659 | B2 | 1/2007 | Staltmeir et al. | |
| 2010/0320044 | A1 * | 12/2010 | Emilsson | 188/202 |
| 2011/0247520 | A1 * | 10/2011 | Liu et al. | 105/197.05 |
| 2011/0253492 | A1 * | 10/2011 | De la Fuente Farias | 188/223.1 |

FOREIGN PATENT DOCUMENTS

| | | | |
|---|---|---|---|
| EP | 1449737 | A1 | 8/2004 |
| WO | 0002756 | A1 | 1/2000 |
| WO | 02074601 | A1 | 9/2002 |

* cited by examiner

*Primary Examiner* — Pamela Rodriguez
(74) *Attorney, Agent, or Firm* — The Webb Law Firm

(57) ABSTRACT

The invention relates to an integrated bogie brake including a brake beam, a brake cylinder, slack adjusters, levers, and brake shoe holders and having suspension links in order to be hanged under a bogie. In order to provide a device with a significantly lower weight and simpler design with the same and better braking characteristics compared to known types of bogie brake systems, the integrated bogie brake according to the invention needs only one single brake beam and the slack adjusters are aligned with the wheels of the bogie.

8 Claims, 4 Drawing Sheets

INTEGRATED BOGIE BRAKE AND SLACK ADJUSTER FOR THE USE WITH SAID INTEGRATED BOGIE BRAKE

CROSS-REFERENCE TO RELATED APPLICATIONS

This application is the United States national phase of International Application No. PCT/EP2012/076987 filed Dec. 27, 2012, and claims priority to Macedonian Patent Application No. P-2011/402 filed Dec. 27, 2011, the disclosures of which are hereby incorporated in their entirety by reference.

Technical Field to which the Invention is Related

The invention in general relates to the area of braking devices for railway vehicles, and regards especially to bogie brake devices and slack adjusters for the use with bogie brake devices. Braking devices are used for the realization of braking of railway vehicles by introducing of air under pressure into the relevant cylinder chamber. Through a system of levers and slack adjusters the created force in the brake cylinder is intensified and transferred directly onto the wheels of the bogie.

Technical Problem that is Resolved with the Invention

The technical problem that is resolved with this invention regards mainly the area of the transfer of braking force directly onto the wheels without the application of complex and heavy lever systems with low efficiency of transfer of the force onto the wheels. There is a need for lighter and cheaper braking devices with a plain construction, particularly for the use with freight wagons.

Technical Background

The brakes of this type are used with railway vehicles from the middle of last century in diverse applications for different types of bogies. The main omissions of the present solutions regard the area of effectiveness of the transfer of the created force of the brake shoes and of the need of application of robust systems for the transfer of the force from the brake cylinders. The development of the railway traffic in the area of transportation of goods in the last decades goes in the direction of increase of the speed of movement and the increase of the freight performance of the wagons. This has a direct impact on the development of the brake engineering. Generally, because of the need for the provision of large brake forces the newest solutions in this area are consistent of two cylinders and two brake beams arranged on a different modality in a very complex form.

The latest developments in this segment are shown in the state of the art documents EP-B1-1 097 075, EP-B1-1 370 452, EP-A1-1 449 737 and U.S. Pat. No. 7,165,659.

The general characteristic of all of the aforementioned patent documents is that these are consisting of complex and hard devices for the production and maintenance in exploitation. The systems of fixation of the brake shoe holders do not provide the parallel state of the complete surface of the brake shoes with the wheel of the bogie that in traffic creates friction of the edge of the brake shoes with the wheel during movement of the wagons.

With all the last innovations the problem of the complex solution of the parking brake is stated that increases the price of the application and maintenance of the brake. The solutions are based on the use of two brake beams because of the impossibility of transfer of brake forces directly onto the wheel.

The main object of this invention is to provide a device with a significantly lower weight and simpler design with the same and better braking characteristics compared to the aforementioned types of bogie brake systems. Moreover, the new device should lead to a universal application with bogies in the respective field.

Technical Solution for the Problem

With an integrated bogie brake according to the present invention, the aforesaid technical problem is solved in that the integrated bogie brake according to the invention needs only one single brake beam and that the slack adjusters are aligned with the wheels of the bogie. This inventive technical solution leads to a comparatively light braking system, since only one brake beam is needed. Moreover, since the slack adjusters are in line with the bogie's wheels, there are far less momentum forces allowing for a further decrease of material for the single brake beam in use.

According to another teaching of the present invention a connection rod with sleeves at its ends serves as a replacement for the secondary beam which is jointly connected to the sleeves.

Preferably, a specially designed brake cylinder with a built-in holder and a piston rod with a piston rod holder allow to arrange the brake cylinder almost fully floating.

In order to provide an easy construction, the shoe holders are connected with the beam and the connection rod with the sleeves through friction rings.

According to another embodiment of the present invention, each slack adjuster on its one end is arranged directly to a shoe holder allowing the transmittal of the braking forces directly.

The present invention also refers to slack adjusters for use with the integrated bogie brake described before. These favored slack adjusters are comprised of a resetting mechanism. Moreover, according to another teaching of the invention, each slack adjuster comprises a trigger mechanism having a trigger and a regulation screw for gap adjusting.

The technical function of the aforementioned slack adjusters will be explained in more detail below in the specific description with regard to the drawings.

BRIEF DESCRIPTION OF THE DRAWINGS

One preferred embodiment of the present invention is shown in the drawing, wherein.

DETAILED DESCRIPTION OF THE EMBODIMENTS

Figure 1:
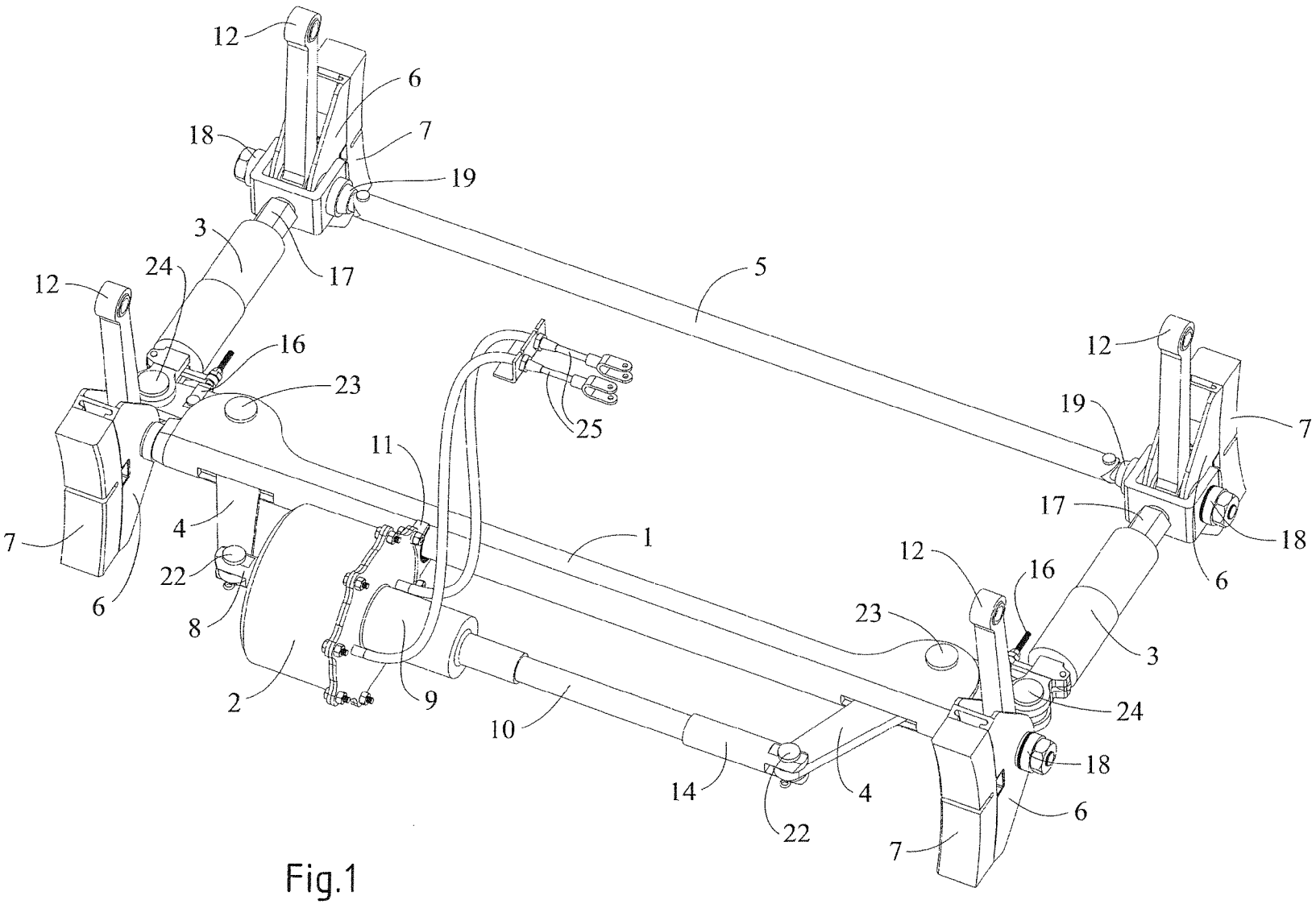
FIG. 1 shows an integrated bogie brake in a perspective view.

The solution of the present invention surpasses the state of the art brake devices using two brake beams. A relatively lightweight (single) beam 1 as shown in FIG. 1 connects a brake cylinder 2 and two slack adjusters 3 through a plurality of levers 4, wherein with one end, the slack adjusters 3 are connected directly to brake shoe holders 6. Each of these brake shoe holders 6 carries one brake shoe 7 and comprises a resetting mechanism 17 between the brake shoe holder 6 and the slack adjusters 3.

The second beam as known from the state of the art braking devices does not exist and is replaced by a connection rod 5 having sleeves 19 at both ends and being arranged between the aforementioned pair of brake shoe holders 6 in order to allow a consistent movement of the braking device in operation.

The brake cylinder 2 comprises a cylinder holder 8, cylinder cover 9, a piston rod 10 and a piston rod holder 14 and is connected at its ends to the levers 4. In the preferred embodiment, the brake system has two levers 4 at the end of the brake cylinder device 2. It is clear that the number and or size of levers 4 at each end can be increased if the forces to be transmitted ask for it. Laterally, the brake cylinder 2 is in an elastic connection with the brake beam 1 via a special holder with a plastic shoe 11 placed on the body of brake cylinder 2.

The main characteristic of the solution of the brake cylinder 2 is that the same is fixed indirectly to the brake beam 1 through four elements in the situation where the brake of the wagon is not activated, i.e. through the pins 22, 23 and 24 as well as the holder with the plastic shoe 11.

This modality of positioning of the brake cylinder 2 with the beam 1 through the holder 11 provides stability of the complete brake system for the whole time of movement of the wagon.

Furthermore, the whole brake system according to the invention is attached to the bogie via four suspension links 12 being arranged swiveling in order to allow a relative movement between brake and wagon bogie during braking operation.

Figure 2:
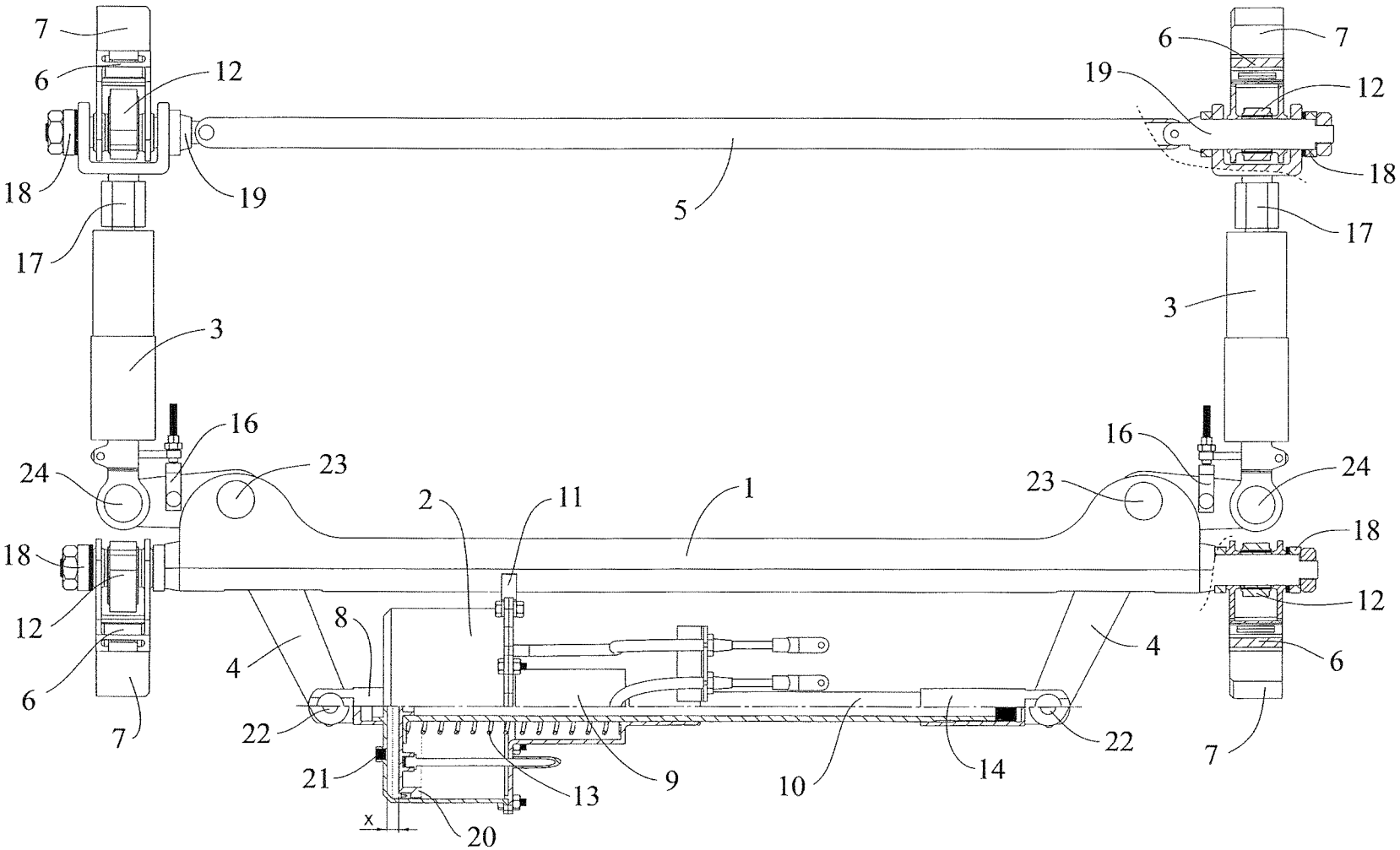
FIG. 2 shows the integrated bogie brake of FIG. 1 in a top view, partially cut open.

FIG. 2 shows the integrated bogie brake of FIG. 1 in a top view, wherein the brake cylinder 2 is shown longitudinally and the (right) ends of the brake beam 1 and sleeve 19 partially cut open indicated with a dotted line.

The positioning of the brake cylinder 2 with the beam 1 through the holder 11 is provided through the reaction force of the return spring 13 illustrated in FIG. 2. The force is provided in this modality where the distance between the levers 4 is regulated with the assistance of a piston rod 10 which can be adjusted by spinning the piston rod holder 14 around the piston 10.

The spinning of the piston rod holder 14 provides the regulated force of the return spring 13 of a piston 20 inside the brake cylinder 2 through the distance between the piston 20 and the cylinder 2 marked with an 'x' in FIG. 2. This is to be used indirectly in the function of positioning and holding the brake cylinder 2 through the holder with a plastic shoe 11 in the assembly of the brake beam 1. Connection 21 is the inlet opening for the pressured air.

Figure 3:
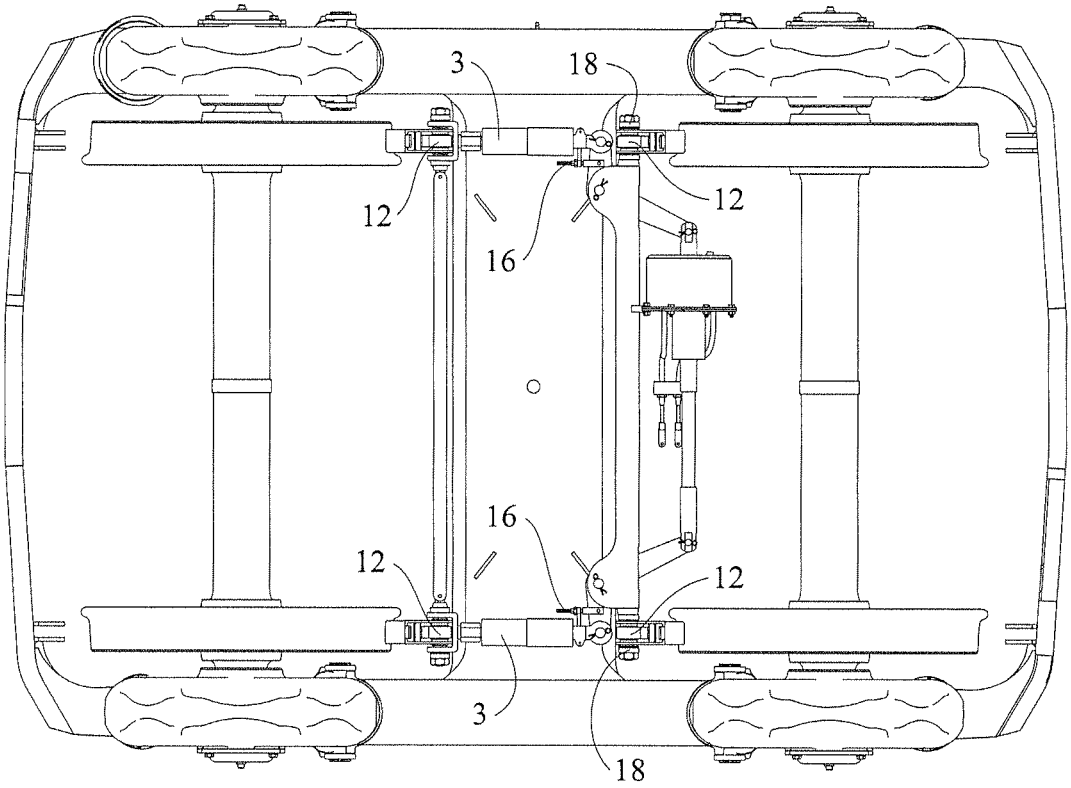
FIG. 3 shows the integrated bogie brake of FIG. 1 arranged in a bogie, both in a top view and a side view.
Figure 3:
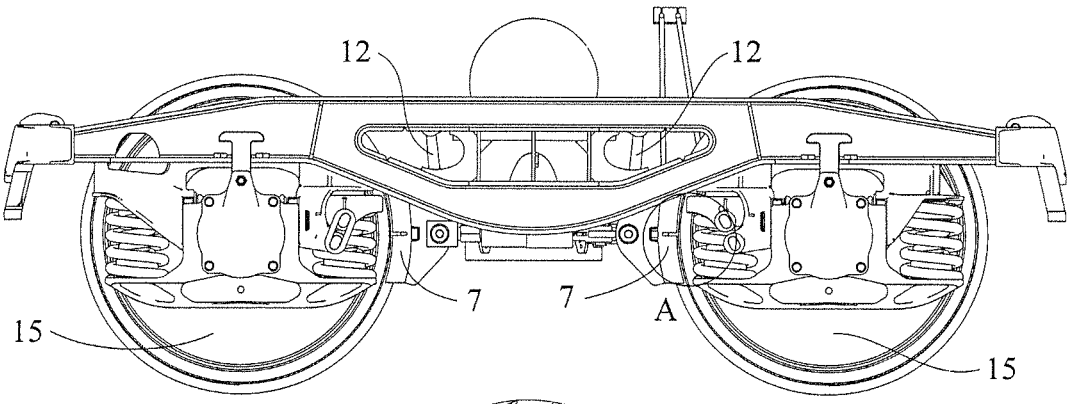
Figure 3:
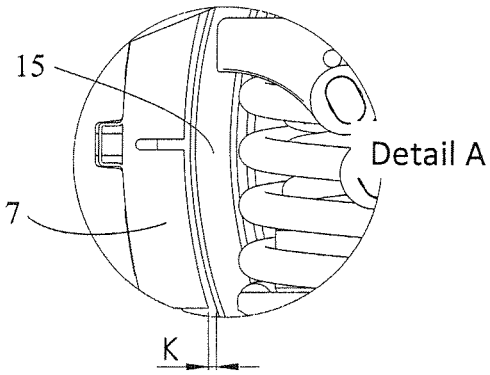

The slack adjusters 3 with resetting mechanism 17 for the adjustment of the brake shoes 7 are positioned in line with the wheels 15 of the bogie as illustrated in FIG. 3 in order to avoid the use of a secondary beam and to obtain a direct transfer of braking force to the brake shoes 7.

Moreover, the slack adjusters 3 with resetting mechanism 17 have the function of two-way slack adjusting and resetting of the whole system in a single process for each pair of shoes 7 at the end of the respective slack adjuster 3. This technical solution differs from all the state of the art solutions mentioned in the introduction of this patent application.

This characteristic is especially important in the application of the integrated brake with the newest types of bogies that do not damage the rails ('truck friendly bogie').

Each slack adjuster 3 is comprised of a trigger 16 which serves for the regulation of the required gap between the wheels 15 and the shoes 7.

The resetting mechanism 17 of the slack adjusters 3 in the initial position during the replacement of worn out shoes 7 has an external form of a hexagonal nut that can be rotated with a standard wrench.

The positioning of the resetting mechanism 17 immediately next to the shoe holder 6 provides easy replacement of the worn out shoes 7 with new shoes because of the good accessibility and is in complete compliance with the new safety regulations customers request in railway operations.

The shoe holders 6 are elastically connected (directly or indirectly) to the brake beam 1 and the connection rod 5 with the sleeves 19 through friction rings 18.

When performing the braking process, the shoes 7 are pressed onto the threads of the wheels 15 and take the position that depends on the loading of the wagon (FIG. 3).

With this technical solution using friction rings 18 an equal gap is obtained between the shoes 7 and the wheel 15 as is illustrated in the 'Detail A' of FIG. 3 and depicted as measure 'K' being easily measurable at both the bottom and the upper side of each shoe 7.

The process of brake release of the system is advantageous over the current existing integrated brake solutions in the market because the brake beam 1 and the connection rod 5 with sleeves 19 do not rotate, they are moving in line with the complete brake system.

In the situation of a sudden loss of one of the brake shoes 7 the flexible joint connection of the connection rod 5 with the sleeves 19 obtains normal functioning of the system because of the possibility of the present design to adjust the total gap appeared in one stroke in the case of shoe loss.

The device for hand braking is comprised of flexible cables 25 that are provided with a pulling mechanism in order to performing a parking brake force for the bogies.

Figure 4:
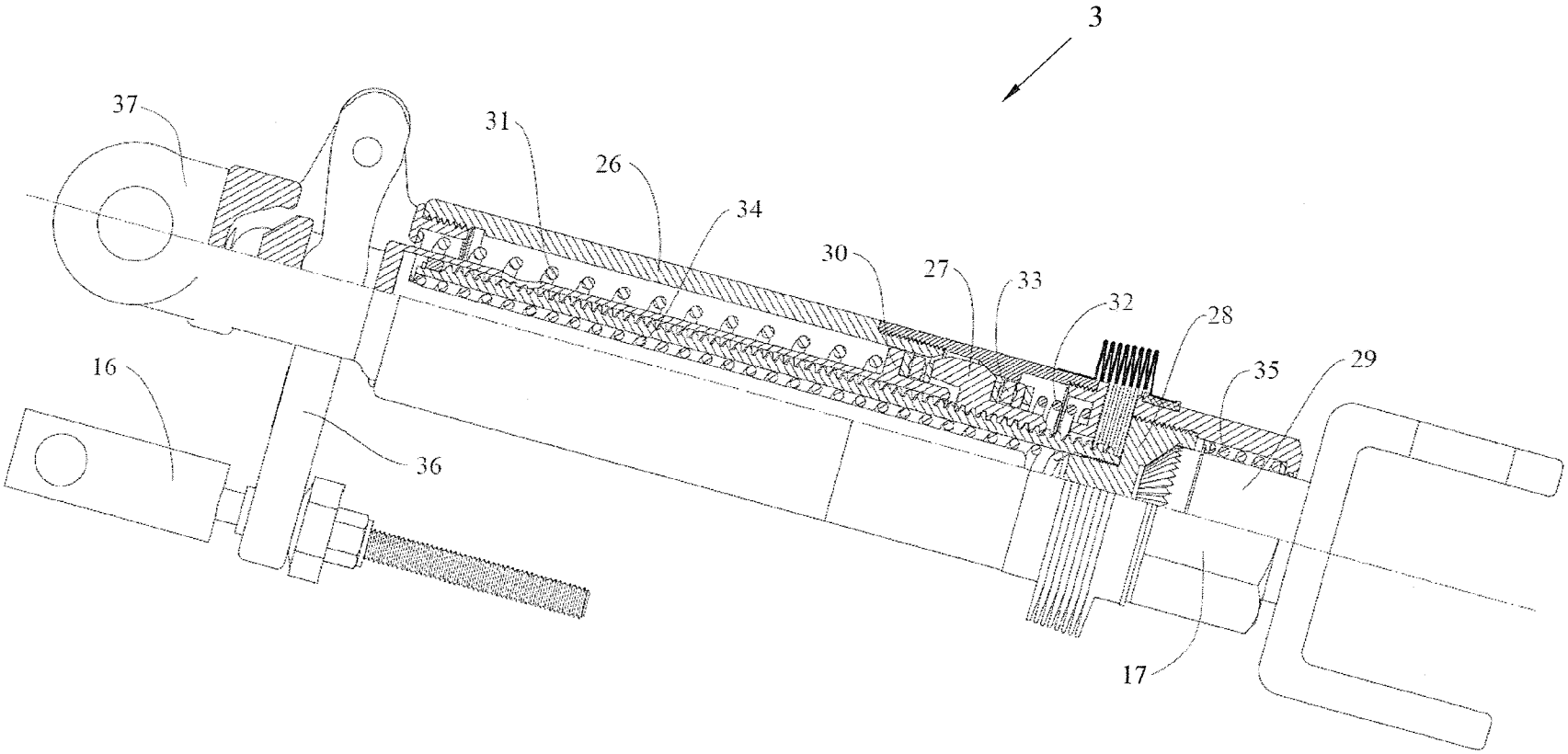
FIG. 4 shows a longitudinal section of a preferred slack adjuster according to the present invention.

A preferred embodiment of a slack adjuster 3 is illustrated in more detail in FIG. 4. Its function is to obtain a proper gap between wheel thread and brake shoe (both not shown). The illustrated version is a double acting pushing type of a slack adjuster. In order to keep the gap (measure K in FIG. 3) adjusted on a predetermined level the slack adjuster 3 holds a trigger mechanism comprised of a trigger 36 and a regulation screw 16.

A working nut 27 is transferring total force from the slack adjuster head 37 and its body 26 through an adjusting spindle 28 to a fork 29. A pulling rod 30 is in contact with the trigger 36 in case of a bigger gap between wheel thread and shoe than the adjusted one. In this situation the trigger 36 moves the pulling rod 30 back which compresses a working spring 31 and obtains free rotation of the working nut 27 between two clutches.

This rotation is the result of a pushing spring 34 force transferred onto the adjuster spindle 28. A spring 32 pushes the working nut 27 through a bearing 33 in a process of nut rotation in order to change the front clutch with rear one.

An adjuster fork having a toothed end 29 is elastically connected with the spindle 28 by a spring 35. The process of worn shoe changing is obtained by a rotation of resetting nut 17 which is fixed to the spindle 28. In this rotation process (reset) the spindle 28 moves back into its initial position.

The invention claimed is:

1. An integrated bogie brake comprising a brake beam, a brake cylinder, slack adjusters, levers, and brake shoe holders and having suspension links in order to be hung under a bogie, wherein the integrated bogie brake comprises only one brake beam and comprises a connection rod with sleeves as a replacement for a secondary beam, wherein the slack adjusters are aligned with the wheels of the bogie.

2. The integrated bogie brake according to claim 1, wherein the connection rod is jointly connected to the sleeves.

3. The integrated bogie brake according to claim 1, wherein the brake cylinder has a built in holder and a piston rod with a piston rod holder.

4. The integrated bogie brake according to claim 1, wherein the brake shoe holders are connected with the brake beam and to the connection rod with the sleeves through friction rings.

5. The integrated bogie brake according to claim 1, wherein each slack adjuster on its one end is arranged directly to a brake shoe holder.

6. The integrated bogie brake according to claim 1, wherein each of the brake shoe holders carries one brake shoe and wherein each slack adjuster comprises a resetting mechanism in order to provide replacement of worn out brake shoes with replacement brake shoes into the brake shoe holders.

7. The integrated bogie brake according to claim 6, wherein each slack adjuster comprises a trigger mechanism for gap adjusting.

8. The integrated bogie brake according to claim 7, wherein the trigger mechanism comprises a trigger and a regulation screw.

* * * * *

UNITED STATES PATENT AND TRADEMARK OFFICE

CERTIFICATE OF CORRECTION

PATENT NO. : 9,283,971 B2
APPLICATION NO. : 14/366044
DATED : March 15, 2016
INVENTOR(S) : Smileski et al.

It is certified that error appears in the above-identified patent and that said Letters Patent is hereby corrected as shown below:

In the Claims

Column 5, Line 12, Claim 5, before “one” delete “its”

Signed and Sealed this
Fifth Day of July, 2016

Michelle K. Lee

Michelle K. Lee
*Director of the United States Patent and Trademark Office*